US006560428B2

(12) United States Patent
Sanchez-Banos et al.

(10) Patent No.: US 6,560,428 B2
(45) Date of Patent: May 6, 2003

(54) TENSIONING AND DETENSIONING ASSEMBLY

(75) Inventors: Julio A. Sanchez-Banos, Webster, NY (US); William G. Osbourne, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/973,641

(22) Filed: Oct. 10, 2001

(65) Prior Publication Data

US 2003/0068176 A1 Apr. 10, 2003

(51) Int. Cl.[7] ..... G03G 15/00
(52) U.S. Cl. ..... 399/165
(58) Field of Search ..... 399/159, 162, 399/165; 198/810.01, 810.04, 807, 840

(56) References Cited

U.S. PATENT DOCUMENTS 5,717,984 A * 2/1998 Wong ..... 399/165
6,134,406 A * 10/2000 Moe et al. ..... 399/165
6,181,900 B1 * 1/2001 Lee et al. ..... 399/165
6,249,662 B1 * 6/2001 Lee ..... 399/165
6,363,600 B2 * 4/2002 Pang ..... 399/165

* cited by examiner

*Primary Examiner*—Hoan Tran
(74) *Attorney, Agent, or Firm*—Tallam Nguti

(57) ABSTRACT

A tension and detensioning assembly includes a frame and a moveable tensioning roll for tensioning the continious loop belt. The moveable tensioning roll has an axis, a first end, a second end, a first position for tensioning the continous loop belt, and a second position when the continous loop belt is detensioned. When the moveable tensioning roll is in the second position, the first end is spaced a first distance from the first position, and the second end is spaced (from the first position) a second distance that is different from the first distance in order to enable safe, efficient and controlled, non-slipping removal and reinstallation of the flexible closed loop photoreceptor belt. The tensioning and detensioning assembly also includes a first moving apparatus for moving the moveable tensioning roll into the first position, and a second moving apparatus including a release device in the form of an elongate member having a first end and a second end, a first edge and a second edge having a first cam surface at the first end and a second cam surface at the second end for moving the first end through the first distance, and the second end through the second distance, thus moving the moveable tensioning roll into the second position, and thereby enabling controlled and non-slipping removal and reinstallation of the belt or photoreceptor.

18 Claims, 4 Drawing Sheets

TENSIONING AND DETENSIONING ASSEMBLY

BACKGROUND OF THE INVENTION

The present invention relates generally to closed loop belt tensioning mechanisms, and more particularly, to a closed loop belt tensioning and detensioning assembly for enabling safe, efficient and controlled, non-slipping removal and reinstallation of a flexible closed loop photoreceptor belt within an electrostatographic reproduction machine.

The invention as such can be utilized in the art of xerography, in the printing arts, or in any machine having a tensioned closed loop belt which from time to time requires removal and reinstallation. The invention however will be described in detail with reference to xerography.

In the practice of conventional xerography, it is the general procedure to form electrostatic latent images on a xerographic surface by first uniformly charging a photoreceptor. The photoreceptor comprises a photoconductive member having a charge retentive surface. The charge on the charge retentive surface is then selectively dissipated in accordance with a pattern of activating radiation corresponding to original images. The selective dissipation of the charge leaves a latent charge pattern on the charge retentive or imaging surface corresponding to an electrostatic latent image that is equivalent to the areas not exposed by radiation.

After the electrostatic latent image is formed or recorded as such on the surface of the photoconductive member, it is subsequently developed by bringing a developer material including toner particles into contact therewith, to thereby form toner images on the surface of the photoconductive member. The images are generally then transferred to a support surface such as to plain paper to which they may be permanently affixed by heating or by the application of pressure or a combination of both.

In addition to the charge retentive layer already mentioned, the photoconductive member includes several other layers each having sensitive and life-limited electrical and electrostatic characteristics that wear out with prolonged use. As such it is a common practice to replace the photoconductive member of a xerographic machine after so many thousand images have been formed and transferred from it in the manner described above. Photoconductive members as such can be in the form of a drum or more commonly in the form of an endless loop belt that is trained and tensioned around a support frame. In either case, every so often, such a drum and a belt loop photoconductor has to be removed and a new one reinstalled from the xerographic or electrostatographic machine.

Typically, conventional xerographic and other machines having a tensioned closed loop belt module employ complicated and expensive mechanisms for positioning the belt module's tensioning roll for the purpose of installing and removing the belt relative to its frame. Such mechanisms can consist of a handle, cables, a pivoting device and several linkages which take up and waste a significant amount of valuable space inside the belt module.

In electrostatographic such machines, whether a vertical or horizontal design, flexible photoreceptor belt loading and unloading onto a photoreceptor belt module requires the detensioning of an idler roll plus the ability to provide removal or installation of the flexible photoreceptor belt without damage. To do this, a tension roll or idler roll must move so as to release the flexible photoreceptor belt, but also in a manner that enables safe, efficient and controlled, non-slipping removal and reinstallation.

SUMMARY OF THE INVENTION

In accordance with the present invention, there is provided a tensioning and detensioning assembly includes a frame and a moveable tensioning roll for tensioning the continuous loop belt. The moveable tensioning roll has an axis, a first end, a second end, a first position for tensioning the continuous loop belt, and a second position when the continuous loop belt is detensioned. When the moveable tensioning roll is in the second position the first end is spaced a first distance from the first position, and the second end is spaced (from the first position) a second distance that is different from the first distance in order to enable safe, efficient and controlled, non-slipping removal and reinstallation of the flexible closed loop photoreceptor belt. The tensioning and detensioning assembly also includes a first moving means for moving the moveable tensioning roll into the first position, and a second moving means for moving the first end through the first distance, and the second end through the second distance, thus moving the moveable tensioning roll into the second position, and thereby enabling controlled and non-slipping removal and reinstallation of the belt or photoreceptor.

BRIEF DESCRIPTION OF THE DRAWINGS

In the detailed description of the invention presented below, reference is made to the drawings, in which.

DETAILED DESCRIPTION OF THE INVENTION

Figure 1:
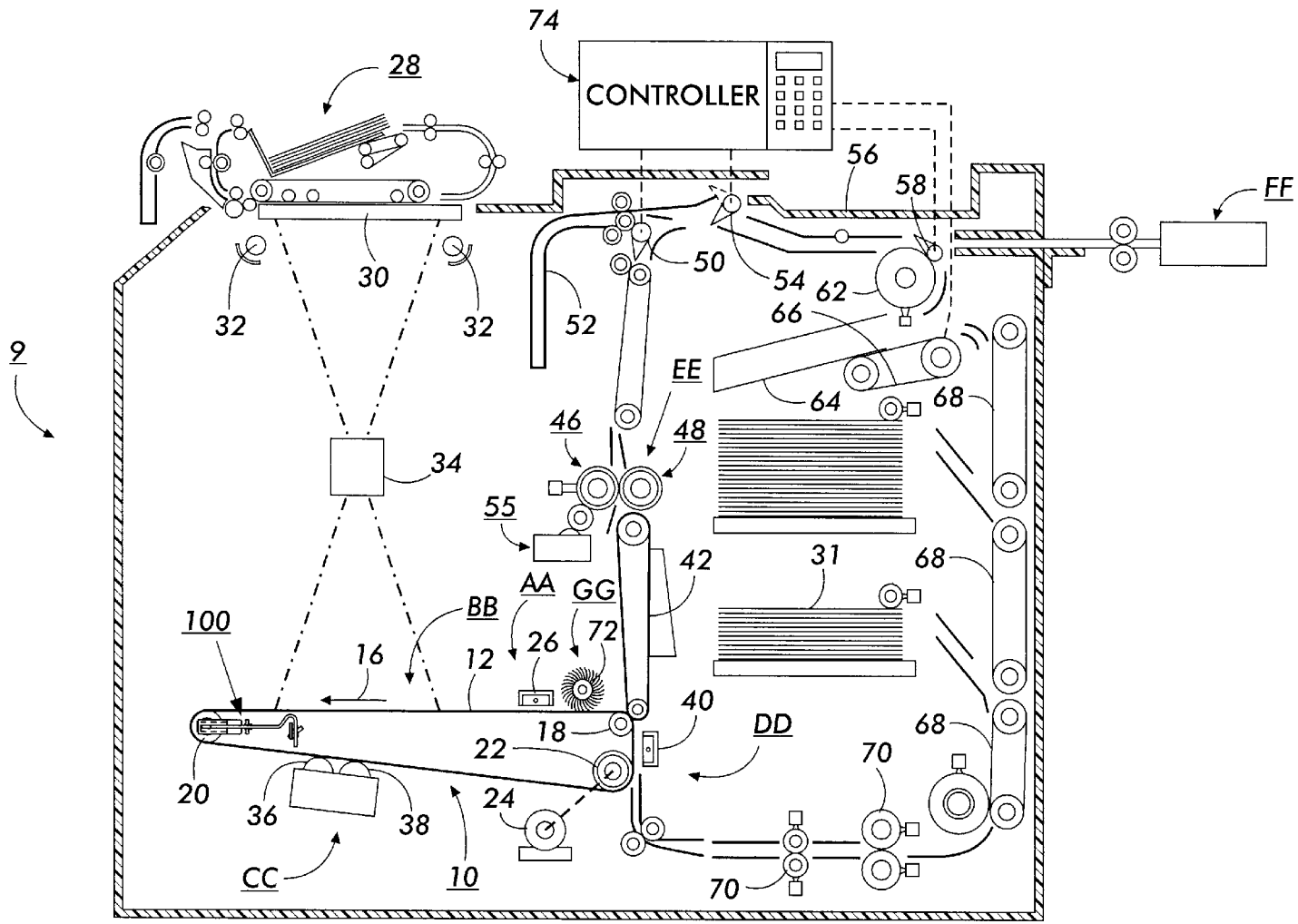
FIG. 1 is a schematic illustration of an exemplary machine, an electrostatographic reproduction machine, including a closed loop belt module including the tensioning and detensioning assembly of the present invention.

For a general understanding of the features of the present invention, reference is made to the drawings. In the drawings, like reference numerals have been used throughout to identify identical elements. FIG. 1 schematically depicts an electrophotographic printing machine 9 incorporating the features of the present invention therein.

Referring to FIG. 1 of the drawings, the electrophotographic printing machine 9 employs a photoconductive member such as a belt 10 having a photoconductive surface 12 deposited on a conductive substrate (not shown). Belt 10 moves in the direction of arrow 16 to advance successive portions of photoconductive surface 12 sequentially through various electrostatographic processing stations disposed about a path of movement thereof. As shown, belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of the photoconductive belt 10 passes through a charging station AA. At charging station AA, a corona generating device, indicated generally by the reference numeral 26, charges photoconductive surface 12 of belt 10 to a relatively high, and substantially uniform potential.

Next, the charged portion of photoconductive surface 12 is advanced through an imaging station BB. At imaging station BB, a document handling unit, indicated generally by the reference numeral 28, is positioned over a platen 30 of the printing machine. Document handling unit 28 sequentially feeds documents from a stack of documents placed by an operator, for example, face up in a normal forward collated order in a document stacking and holding tray. A document feeder located below the tray forwards the bottom document in the stack to a pair of take-away rollers. The belt advances the document to platen 30. After imaging, the original document is fed from platen 30 by the belt into a guide and feed roller pair. The document then advances into an inverter mechanism and back to the document stack through the feed roller pair. A position gate is provided to divert the document to the inverter or to the feed roller pair.

Imaging of a document is achieved, for example, using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document.

Obviously, electronic imaging of page image information could be facilitated by a electrostatographic reproduction machine utilizing electrical imaging signals. The electrostatographic reproduction machine can be a digital printer including an input device such as a Raster Input Scanner (RIS) and a printer output device such as a Raster Output Scanner (ROS), or a printer utilizing only a printer output device such as a ROS.

Thereafter, belt 10 advances the electrostatic latent image recorded on photoconductive surface 12 to a development station CC. At development station CC, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station DD.

At transfer station DD, a copy sheet is moved into contact with the toner powder image. Transfer station DD includes a corona generating device 40 which sprays ions onto the backside of the copy sheet. This attracts the toner powder image from photoconductive surface 12. After transfer, a conveyor 42 advances the copy sheet to a fusing station EE of the present invention.

Generally, fusing station EE includes a fuser assembly which heats and permanently affixes the transferred toner powder image to the copy sheet. As further shown, fuser assembly includes a heated fuser roller 46 and a back-up or pressure roller 48 with the powder image on the copy sheet contacting fuser roller 46. The pressure roller 48 is cammed against the fuser roller 46 to provide necessary pressure for fixing the toner powder image to the copy sheet.

After fusing, copy sheets of the fused images are fed to gate 50 which functions as an inverter selector. Depending upon the position of gate 50, the copy sheets are deflected to sheet inverter 52 or bypass inverter 52 and are fed directly to a second decision gate 54. At gate 54, the sheet is in a face up orientation with the image side, which has been fused, face up. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roller 62, or onto a transport path to finishing station FF.

At finishing station FF, copy sheets are stacked in a compiler tray and attached to one another to form sets. The sheets are attached to one another by either a binding device or a stapling device. In either case, a plurality of sets of documents are formed in finishing station FF. When decision gate 58 diverts the sheet onto inverter roller 62, roller 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed seriatim, by bottom feeder 66 from tray 64 back to transfer station DD via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station DD so that the toner powder image is transferred thereto. The duplex sheet is then fed through the same path as the simplex sheet to be stacked in tray 56 or, when the finishing operation is selected, to be advanced to finishing station FF.

Invariably, after the copy sheet is separated from photoconductive surface 12 of belt 10, some residual particles remain adhering thereto. These residual particles are removed from photoconductive surface 12 at cleaning station GG. Cleaning station GG includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station FF.

Typically, conventional machines having a belt photoreceptor module employ complicated and expensive mechanisms for positioning the belt photoreceptor module's tensioning roll for the purpose of installing and removing the belt photoreceptor relative to its frame. Such mechanisms can consist of a handle, cables, a pivoting device and several linkages which take up and waste a significant amount of valuable space inside the belt photoreceptor module.

Whether a vertical or horizontal design, photoreceptor loading and unloading requires the detensioning of an idler roll plus the ability to provide removal or installation of a flexible photoreceptor without damage. To do this, the tension roll or idler roll must not only move from its tensioned position in order to release the photoreceptor belt, but it must also provide more movement at the front of the module than at the back in order to still provide some tension for belt retention.

Referring now to FIGS. 1 to 5, there is provided in accordance with the present invention, a tensioning and detensioning assembly 100 on the continuous photoreceptor loop belt 10 for enabling safe, efficient and controlled, non-slipping removal and reinstallation of the flexible closed loop photoreceptor belt 10 within the electrostatographic reproduction machine 9.

Figure 2:
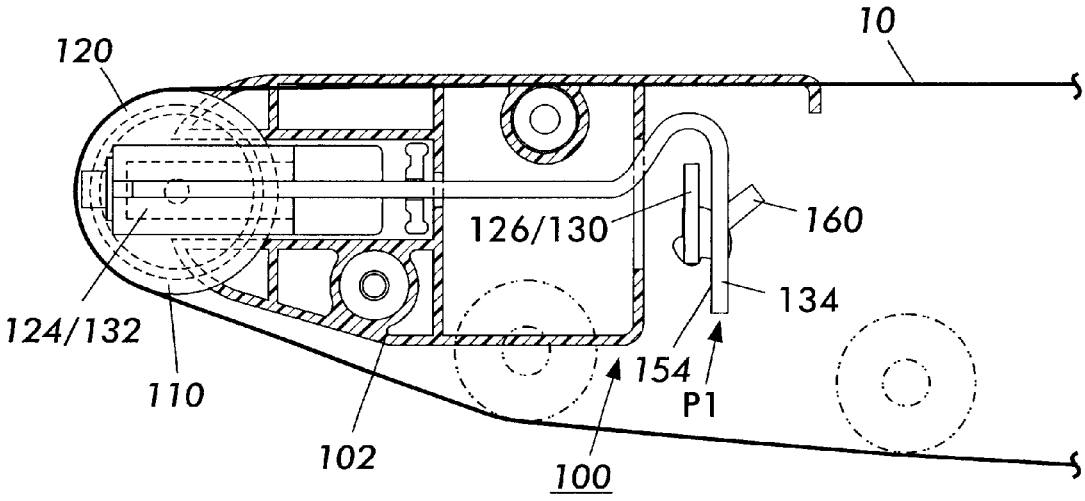
FIG. 2 is a schematic illustration of enlarged portion of the closed loop belt module of FIG. 1 including the tensioning and detensioning assembly in a tensioned position.
Figure 3:
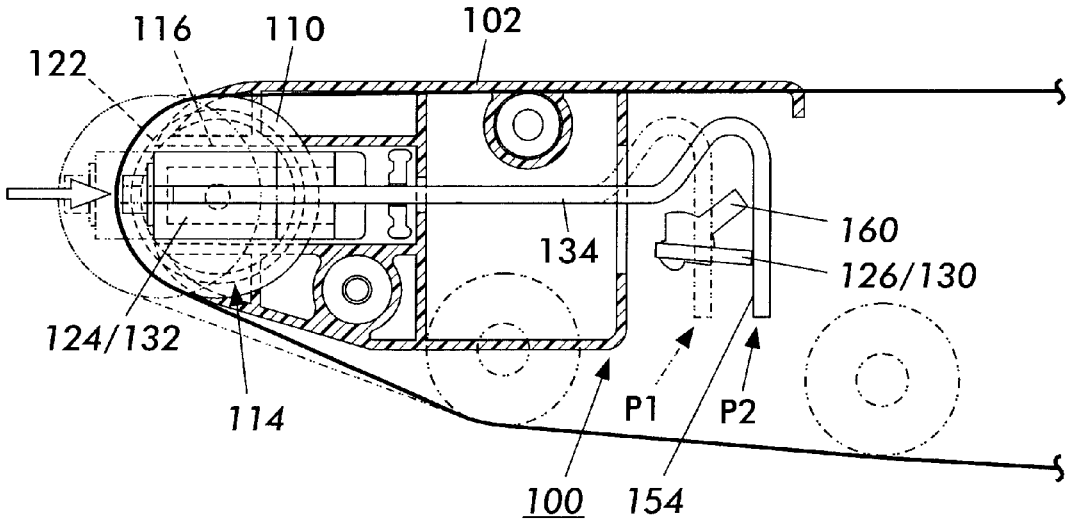
FIG. 3 is the same as FIG. 2 but showing the tensioning and detensioning assembly in a detensioned position.

As illustrated in FIGS. 2 and 3 in particular, the tensioning and detensioning assembly 100 includes a frame 102 and a moveable tensioning roll 110 for tensioning the continuous loop belt 10. The moveable tensioning roll 110 has an axis a first end 114, a second end 116, a first position 120 for tensioning the continuous loop belt 10, and a second position 122 when the continuous loop belt 10 is detensioned. When the moveable tensioning roll is in the second position 122, the first end 114 is spaced a first distance D1 from the first position 120, and the second end 116 is spaced (from the first position 120) a second distance D2 that is different from the first distance D1 in order to enable safe, efficient and controlled, non-slipping removal and reinstallation of the flexible closed loop photoreceptor belt 10.

The tensioning and detensioning assembly 100 also includes a first moving means 124 for moving the moveable tensioning roll 110 into the first position 120, and a second moving means 126 for moving the first end 114 through the first distance D1, and the second end 116 through the second distance D2, thus moving the moveable tensioning roll 110 into the second position 122, and thereby enabling controlled and non-slipping removal and reinstallation of the belt or photoreceptor 10.

The first moving means 124 are attached to the frame 102 for moving the tensioning roll 110 into the first position 120 in order to tension the continuous loop belt 10. In accordance with the present invention, the second moving means 126 comprises release means 130 associated with the frame 102 for releasing the first end 114 the first distance D1 from the first position 120, and for releasing the second end 116 the second distance D2 from the first position 120. The second distance D2 is different from the first distance D1 so as to enable controlled, non-slipping removal and reinstallation of the continuous loop belt 10. In one embodiment, the second distance D2 is less than the first distance D1.

As illustrated, the first end 114 is outboard and the second end 116 is inboard relative to an operator removing and reinstalling the continuous loop belt 10. The first moving means 124 can be a biasing spring 132 for normally biasing the tensioning roll 110 into the first or tensioned position 120. The tensioning and detensioning assembly 100 also includes at least one pull bracket 134, 136 that is attached to the tensioning roll 110 for pulling against the biasing spring 132 in order to move the tensioning roll 110 from the first, tensioned position 120 (FIG. 2) towards the second, detensioned position 122 (FIG. 3). In one embodiment, the tensioning and detensioning assembly 100 includes a first pull bracket 134 that is attached to the first end 114 of the tensioning roll 110, and a second pull bracket 136 that is attached to the second end 116 of the tensioning roll 110. As further shown, the first and second pull brackets 134, 136 have a first position shown as P1 when the belt 10 is in the tensioned position 120, and a second position P2 when the belt 10 is in the detensioned position 122.

Figure 4:
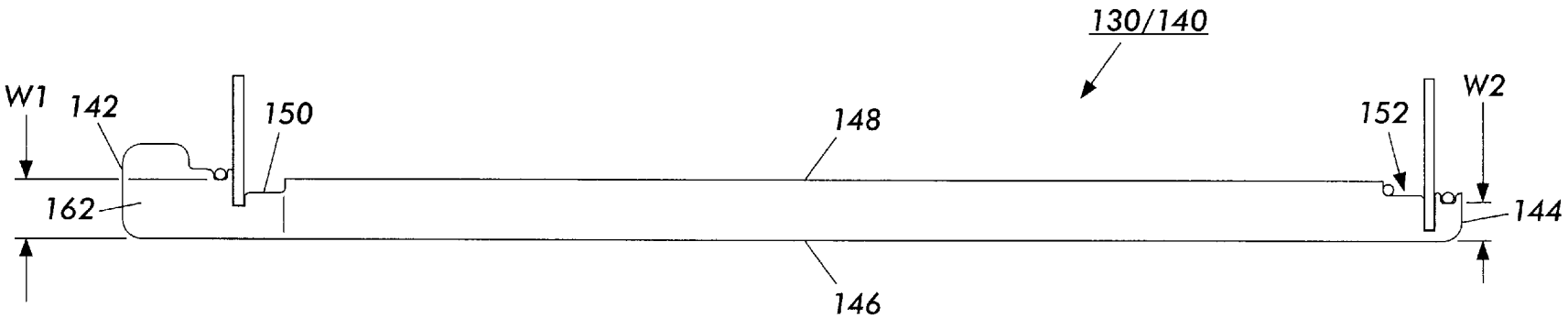
FIG. 4 is a schematic illustration of the cam blade mechanism of the tensioning and detensioning assembly of the present invention (in a vertical position with the belt tensioned) and FIG. 5 is a schematic illustration of the cam blade mechanism of the tensioning and detensioning assembly of the present invention (in a horizontal position with the belt detensioned).
Figure 5:
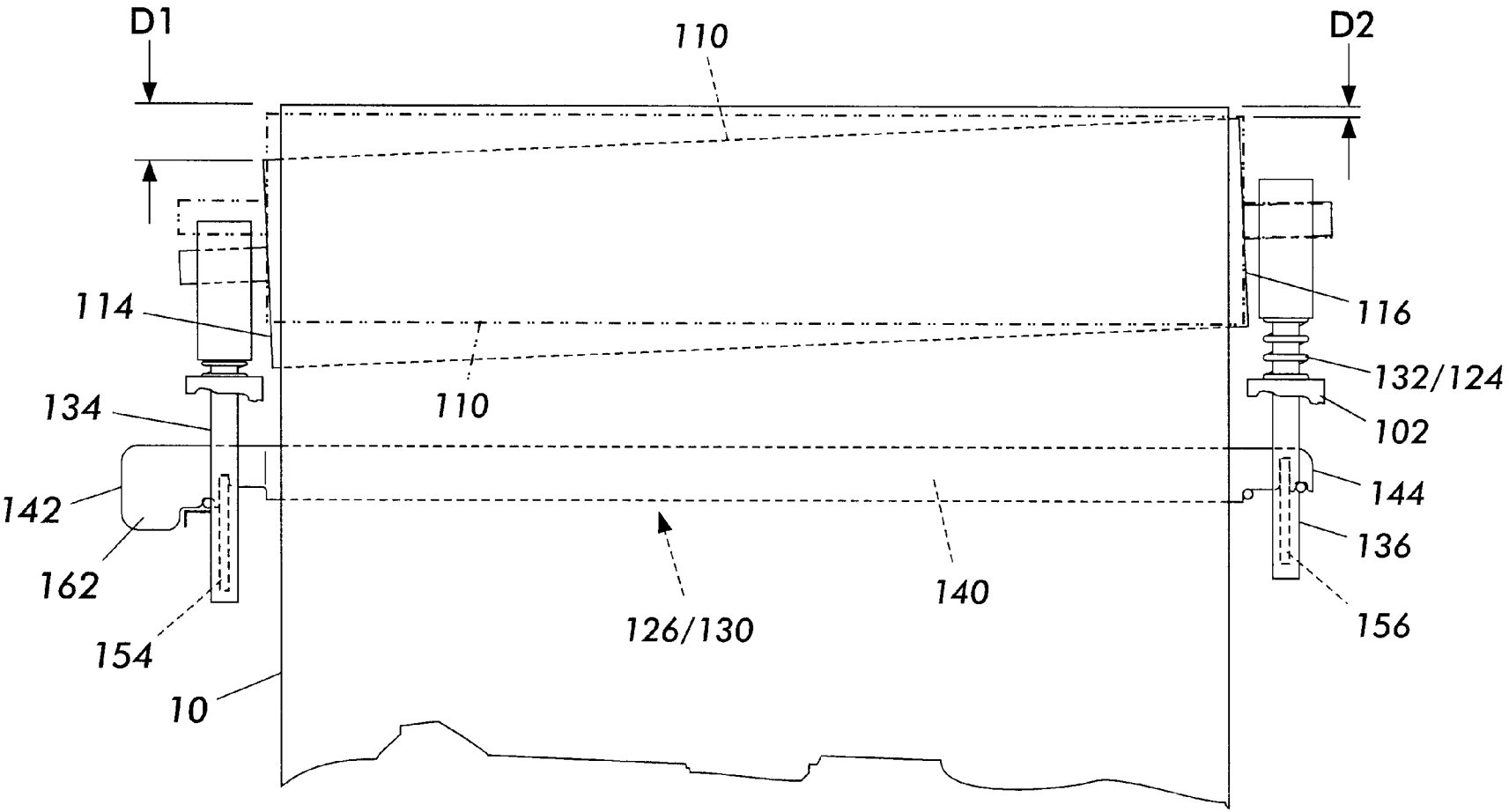

Referring in particular to FIGS. 4 and 5, the release means 130, for example, comprises an elongate, flat, blade shaped member 140 that has a first end 142 and a second end 144, a first edge 146 and a second edge 148. The second edge 148 as illustrated has a first cam surface 150 at the first end 142 and a second cam surface 152 at the second end 144 for engaging and moving the pull bracket from its first position P1 to its second position P2. A first edge-to-edge width W1 of the first end 142 (as measured between the first edge and the first cam surface of the second edge) is made less than a second edge-to-edge width W2 of the second end 144 (as measured between the first edge and the second cam surface of the second edge). The at least one pull bracket 134, 136 includes a cam follower edge 154,156 for following the cam surface 150,152 on the release member 130.

The cam surfaces comprise cutouts (not labeled) one at the front or first end of the tensioning roll, and another at the rear. In addition to the edge-to-edge widths, W1, W2 being different, the cutouts are also at different depths, thereby resulting in less travel of the linkage or pull bracket 134, 136 at the rear (inboard) as well as in more travel at the front (outboard). Thus, as described, the first end 114 of the tensioning roll 110 is outboard (front) and the second end 116 thereof is inboard (rear) relative to an operator removing and reinstalling the continuous belt 10. The release member includes a handle portion 162 at its first end 142 for enabling manual rotation thereof from its vertical (FIG. 2) to its horizontal (FIG. 3) positions.

Operationally, the release member or cam blade 130 as illustrated in FIGS. 2 and 4, is positioned within a slot 160 on its first edge 146 so that its widths W1, W2 are vertical and represent its height within the tensioning and detensioning assembly 100. In this position, the biasing spring 132 urges the tensioning roll 110 into its tensioned first position 120 and so the pull brackets 134, 136 are moved to the left as illustrated in FIG. 2. To release or move the tensioning roll into its second and detensioned position 122 (FIG. 3), the release member or cam blade 130 is rotated clockwise within the slot 160 so that its widths W1, W2 are now horizontal (FIG. 5) within the tensioning and detensioning assembly 100. During such rotation, the cam follower edges 154, 156 of the pull brackets 134, 136 engage the cutouts in the cam surfaces 150, 152 and are thus pushed to the right (FIG. 3) a distance equivalent to the widths W1 at the front and W2 at the rear. The difference in release or travel distance between the front and the rear allows for a safe, efficient and controlled, non-slipping removal and reinstallation of the flexible closed loop photoreceptor belt 10 within the electrostatographic reproduction machine 9.

As can be seen, there has been provided a tensioning and detensioning assembly which includes a frame and a moveable tensioning roll for tensioning the continuous loop belt. The moveable tensioning roll has an axis, a first end, a second end, a first position for tensioning the continuous loop belt, and a second position when the continuous loop belt is detensioned. When the moveable tensioning roll is in the second position, the first end is spaced a first distance from the first position, and the second end is spaced (from the first position) a second distance that is different from the first distance in order to enable safe, efficient and controlled, non-slipping removal and reinstallation of the flexible closed loop photoreceptor belt. The tensioning and detensioning assembly also includes a first moving means for moving the moveable tensioning roll into the first position, and a second moving means for moving the first end through the first distance, and the second end through the second distance, thus moving the moveable tensioning roll into the second position, and thereby enabling controlled and non-slipping removal and reinstallation of the belt or photoreceptor.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A tensioning and detensioning assembly for a continuous loop belt used in a machine, the tensioning and detensioning assembly comprising:

a. a frame;

b. a moveable tensioning roll for tensioning the continuous loop belt, said moveable tensioning roll having a first end, a second end, a first position for tensioning the continuous belt, and a second position for detensioning the continuous belt, said first end being spaced a first distance from said first position when said moveable roll is in said second position, and said second end being spaced a second distance from said first position when said moveable roll is in said second position, said second distance being different from said first distance;

c. a first moving means for moving said moveable tensioning roll into said first position; and d. a second moving means for moving said first end said first distance and said second end said second distance to move said removeable roll into said second position, thereby enabling safe, controlled and non-slipping removal and reinstallation of the continuous belt, said second moving means comprising an elongate member having a first end and a second end, a first edge and a second edge, said second edge having a first cam surface at said first end and a second cam surface at said second end.

2. A tensioning and detensioning assembly for a continuous loop belt used in a machine, the tensioning and detensioning assembly comprising:

a. a frame;

b. a tensioning roll assembly including a tensioning roll having a first end, and a second end, and a first position and a second position relative to said frame;

c. moving means attached to said frame for moving said tensioning roll into said first position for tensioning the continuous belt; and d. release means associated with said frame for releasing said first end a first distance from said first position, and said second end a second distance from said first position, said second distance being different from said first distance, thereby for enabling safe, controlled and non-slipping removal and reinstallation of the continuous belt, said release means comprising an elongate member having a first end and a second end, a first edge and a second edge, said second edge having a first cam surface at said first end and a second cam surface at said second end.

3. The tension and detensioning assembly of claim 2, wherein said first end is outboard and said second end is inboard relative to an operator removing and reinstalling the continuous belt, and said first distance is greater than said second distance.

4. The tension and detensioning assembly of claim 2, wherein said moving means comprises a biasing spring for normally biasing said tensioning roll of said tensioning assembly into said first position.

5. The tension and detensioning assembly of claim 2, wherein a width of said first end between said first edge and said first cam surface is greater than a width of said second end between said first edge and said second cam surface.

6. The tension and detensioning assembly of claim 2, wherein said elongate member comprises a blade-shaped member.

7. The tension and detensioning assembly of claim 2, wherein said tensioning roll assembly includes at least one pull bracket attached to said tensioning roll for pulling against a biasing spring to move said tensioning roll from said first position towards said second position.

8. The tension and detensioning assembly of claim 7, wherein said at least one pull bracket includes a cam follower edge for following said cam surface on said release member.

9. The tension and detensioning assembly of claim 2, wherein said tensioning roll assembly includes a first pull bracket attached to said first end of said tensioning roll, and a second pull bracket attached to said second end of said tensioning roll.

10. An electrostatographic reproduction machine comprising:

a. a machine frame;

b. an endless loop image bearing member including an imaging surface for forming and transferring images; and c. a tensioning and detensioning assembly for tensioning and detensioning said endless loop image bearing member so as to enable safe, non-slipping removal and reinstallation of said endless loop image bearing member, said tensioning and detensioning assembly including:

i. a frame;

ii. a tensioning roll assembly including a tensioning roll having a first end, and a second end, and a first position and a second position relative to said frame;

iii. moving means attached to said frame for moving said tensioning roll into said first position for tensioning the endless loop image bearing member; and iv. release means associated with said frame for releasing said first end a first distance from said first position, and for releasing said second end a second distance from said first position, said second distance being different from said first distance for enabling controlled, non-slipping removal and reinstallation of the endless loop image bearing member, said release means comprising an elongate member having a first end and a second end, a first edge and a second edge, said second edge having a first cam surface at said first end and a second cam surface at said second end.

11. The electrostatographic reproduction machine of claim 10, wherein said first end is outboard and said second end is inboard relative to an operator removing and reinstalling the continuous belt, and said second distance is less than said first distance.

12. The electrostatographic reproduction machine of claim 10, wherein said moving means comprises a biasing spring for normally biasing said tensioning roll of said tensioning assembly into said first position.

13. The electrostatographic reproduction machine of claim 10, wherein a width of said first end between said first edge and said first cam surface is greater than a width of said second end between said first edge and said second cam surface.

14. The electrostatographic reproduction machine of claim 10, wherein said elongate member comprises a blade shape member.

15. The electrostatographic reproduction machine of claim 10, wherein said tensioning roll assembly includes at least one pull bracket attached to said tensioning roll for pulling against said biasing spring to move said tensioning roll from said first position towards said second position.

16. The electrostatographic reproduction machine of claim 15, wherein said at least one pull bracket includes a cam follower edge for following said cam surface on said release member.

17. The electrostatographic reproduction machine of claim 15, wherein said release member includes a handle portion at said first end for enabling manual rotation thereof from its vertical to its horizontal positions.

18. The electrostatographic reproduction machine of claim 10, wherein said tensioning roll assembly includes a first pull bracket attached to said first end of said tensioning roll, and a second pull bracket attached to said second end of said tensioning roll.

* * * * *